US007330088B2

(12) United States Patent
Aramaki et al.

(10) Patent No.: US 7,330,088 B2
(45) Date of Patent: Feb. 12, 2008

(54) WAVEGUIDE ORTHOMODE TRANSDUCER

(75) Inventors: Yoji Aramaki, Tokyo (JP); Naofumi Yoneda, Tokyo (JP); Moriyasu Miyazaki, Tokyo (JP); Akira Tsumura, Tokyo (JP); Toshiyuki Horie, Tokyo (JP)

(73) Assignee: Mitsubishi Denki Kabushiki Kaisha, Tokyo (JP)

( * ) Notice: Subject to any disclaimer, the term of this patent is extended or adjusted under 35 U.S.C. 154(b) by 112 days.

(21) Appl. No.: 10/517,838

(22) PCT Filed: Apr. 2, 2004

(86) PCT No.: PCT/JP2004/004859

§ 371 (c)(1),
(2), (4) Date: Dec. 15, 2004

(87) PCT Pub. No.: WO2004/091034

PCT Pub. Date: Oct. 21, 2004

(65) Prior Publication Data

US 2005/0200430 A1 Sep. 15, 2005

(30) Foreign Application Priority Data

Apr. 4, 2003 (JP) ..... 2003-101798

(51) Int. Cl.
*H01P 5/12* (2006.01)

(52) U.S. Cl. ..... 333/137; 333/135; 333/21 R

(58) Field of Classification Search ..... 333/137, 333/135, 21 A, 21 R, 126
See application file for complete search history.

(56) References Cited

U.S. PATENT DOCUMENTS 4,365,253 A 12/1982 Mörz (Continued)

FOREIGN PATENT DOCUMENTS

JP 26-1758 B 4/1951

(Continued)

OTHER PUBLICATIONS

"Advanced Computer Design for a High Performance Compact Orthomode Transducer"; Antennas and Propagation Society International Symposium; G. Bertin et al.; vol. 4; Jun. 21, 1998; pp. 2254-2257.

(Continued)

*Primary Examiner*—Robert Pascal
*Assistant Examiner*—Kimberly E. Glenn
(74) *Attorney, Agent, or Firm*—Birch, Stewart, Kolasch & Birch, LLP

(57) ABSTRACT

A waveguide orthomode transducer includes a first radio wave conducting means for conducting an electric wave of a horizontally polarized wave branched by an electric wave branch means, for conducting another electric wave of the horizontally polarized wave, for combining the electric waves of the horizontally polarized wave into one electric wave and dividing this electric wave into an electric wave of a basic mode and an electric wave of a higher mode, and for outputting them, and a second radio wave conducting means for conducting one electric wave of a vertically polarized wave branched by the electric wave branch means, for conducting another electric wave of the vertically polarized wave, for combining the electric waves of the vertically polarized wave into one electric wave and dividing this electric wave into an electric wave of a basic mode and an electric wave of a higher mode, and for outputting them.

7 Claims, 3 Drawing Sheets

U.S. PATENT DOCUMENTS

| | | | | |
|---|---|---|---|---|
| 4,504,805 | A * | 3/1985 | Ekelman et al. | 333/126 |
| 5,536,361 | A * | 7/1996 | Kondo et al. | 438/492 |
| 6,087,908 | A | 7/2000 | Haller et al. | |
| 2002/0021184 | A1 | 2/2002 | Rosenberg et al. | |

FOREIGN PATENT DOCUMENTS

| | | | |
|---|---|---|---|
| JP | 54-115842 | | 2/1979 |
| JP | 55-28676 | A | 2/1980 |
| JP | 58-111403 | A | 7/1983 |
| JP | 58-205304 | A | 11/1983 |
| JP | 60-1902 | A | 1/1985 |
| JP | 60-001902 | A | 1/1985 |
| JP | 60-30606 | U | 3/1985 |
| JP | 60-57721 | B2 | 12/1985 |
| JP | 61-52002 | A | 3/1986 |
| JP | 62-181003 | U | 11/1987 |
| JP | 1-49202 | B2 | 10/1989 |
| JP | 10-28003 | A | 1/1998 |
| JP | 11-17402 | A | 1/1999 |
| JP | 11-330801 | A | 11/1999 |

OTHER PUBLICATIONS

"Analysis and Design of Broadband Thin OMT With Turnstile Junction", Yoji Aramaki et al., The Institute of Electronics, Information and Communication Engineers, General Conference 2003, Mar. 2003, C-2-44, p. 76.

"Ku-Band Ultra-Thin Broadband OMT", Yoji Aramaki et al., The Institute of Electronics, Information and Communication Engineers, Society Conference 2003, Sep. 2003, C-2-70, p. 94.

"Ultra-Thin Broadband OMT Turnstile Junction", Yoji Aramaki et al.; IEEE MTT-S Digest, TU2B-5, 2003, p. 47.

"Ultra-Thin Broadband OMT With Turnstile Junction", Yoji Aramaki et al., The Institute of Electronics, Information and Communication Engineers, Technical Report, MW2003-52, 2003, pp. 31-35.

Boifot. Anton M, "Classification of Ortho-Mode Transducers" European Transactions on Telecommunications and Related Technologies; 2(1991) Sep./Oct., vol. 2, No. 5, Milano, Italy; pp. 503-510; XP000266379.

* cited by examiner

WAVEGUIDE ORTHOMODE TRANSDUCER

FIELD OF THE INVENTION

The present invention relates to a waveguide orthomode transducer used in, for example, a VHF band, a UHF band, a microwave band, and a millimeter wave band.

BACKGROUND OF THE INVENTION

A prior art waveguide orthomode transducer is provided with a main waveguide including a metallic thin plate disposed at its branch portion, the metallic thin plate having circular notches which are so formed as to be bilaterally symmetric with each other.

Since this metallic thin plate is so formed, a horizontally polarized electric wave H of a basic mode inputted to the waveguide orthomode transducer via an input terminal P1 is branched into two routes which are right-angled and symmetric with respect to the direction of the axis of the main waveguide, and the two parts are outputted from output terminals P3 and P4, respectively.

On the other hand, a vertically polarized electric wave V of a basic mode inputted to the waveguide orthomode transducer via the input terminal P1 is outputted from another output terminal P2 which is opposite to the input terminal P1 (refer to patent reference 1, for example).

[Patent reference 1] JP,11-330801,A (refer to pp. 4 to 6 and FIG. 1)

A problem with the prior art waveguide orthomode transducer constructed as mentioned above is that since a metallic thin plate is inserted into the branch portion of the main waveguide, the length of the main waveguide along the direction of the axis becomes long and it is therefore difficult to do miniaturization of the waveguide orthomode transducer with respect to the direction of the axis of the main waveguide and to reduce the length of the main waveguide along the direction of the axis.

Since there is a large change in the wavelength of electric waves in the waveguide with respect to frequency in a frequency band in the vicinity of the cut-off frequency of the vertically polarized electric wave of the basic mode and the horizontally polarized wave, and there is also a rapid change in the impedance discontinuity with respect to frequency at the branch portion of the main waveguide, it is difficult to suppress degradation in the reflection characteristics of both the vertically polarized wave and the horizontally polarized wave in the frequency band in the vicinity of the cut-off frequency.

The present invention is made in order to solve the above-mentioned problems, and it is therefore an object of the present invention to provide a high-performance waveguide orthomode transducer that can come down in size and can have a waveguide whose axis is downsized.

DISCLOSURE OF THE INVENTION

A waveguide orthomode transducer in accordance with the present invention is provided with a first radio wave conducting means for conducting an electric wave of a horizontally polarized wave branched by an electric wave branch means, for conducting another electric wave of the horizontally polarized wave, for combining the electric waves of the horizontally polarized wave into one electric wave and dividing this electric wave into an electric wave of a basic mode and an electric wave of a higher mode, and for outputting them, and a second radio wave conducting means for conducting one electric wave of a vertically polarized wave branched by the electric wave branch means, for conducting another electric wave of the vertically polarized wave, for combining the electric waves of the vertically polarized wave into one electric wave and dividing this electric wave into an electric wave of a basic mode and an electric wave of a higher mode, and for outputting them.

Therefore, the present invention offers an advantage of being able to do miniaturization of the waveguide orthomode transducer and reduce the length of the axis of the waveguide orthomode transducer, and to enhance the performance of the waveguide orthomode transducer.

PREFERRED EMBODIMENTS OF THE INVENTION

Hereafter, in order to explain this invention in greater detail, the preferred embodiments of the present invention will be described with reference to the accompanying drawings.

Embodiment 1

Figure 1:
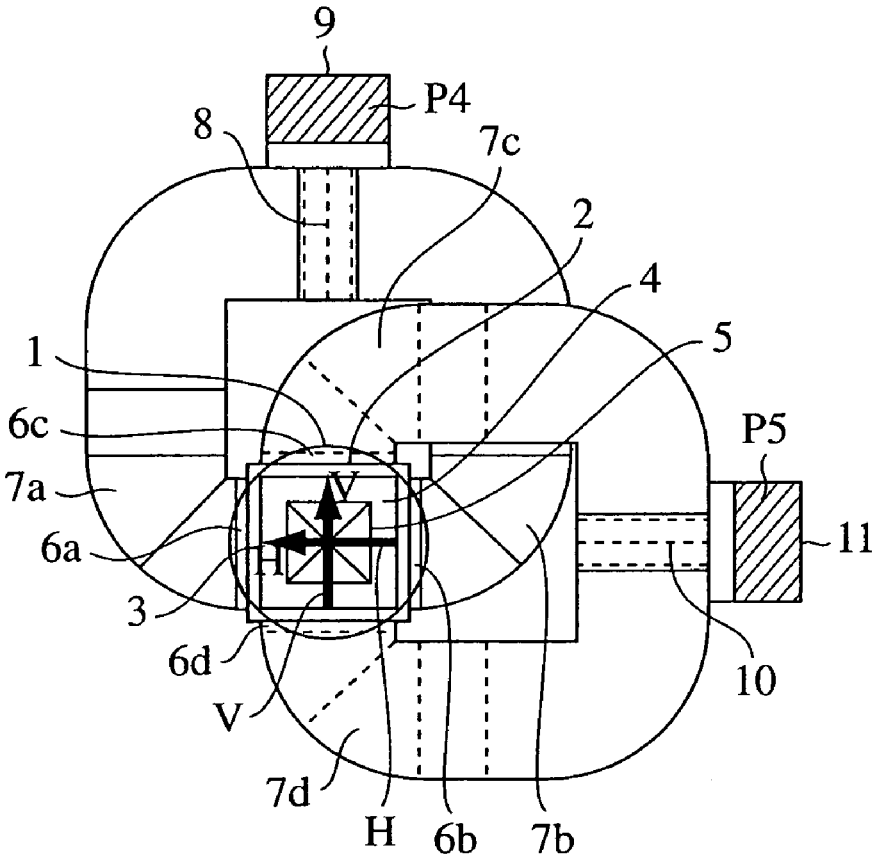
FIG. 1 is a plan view showing a waveguide orthomode transducer according to embodiment 1 of the present invention.
Figure 2:
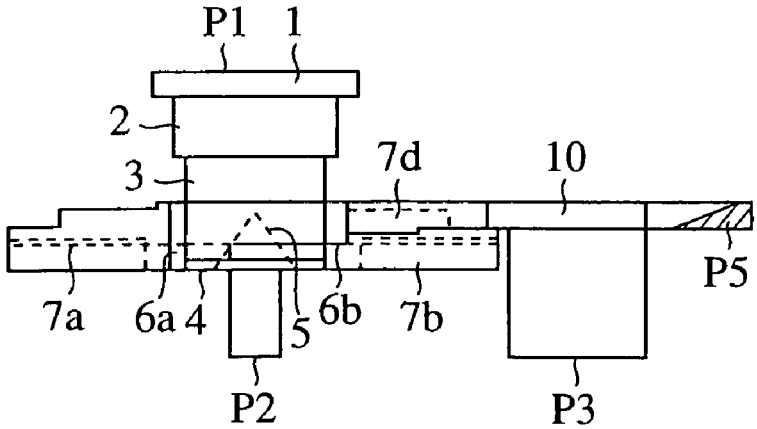
FIG. 2 is a side view showing the waveguide orthomode transducer according to embodiment 1 of the present invention.

FIG. 1 is a plan view showing a waveguide orthomode transducer according to embodiment 1 of the present invention, and FIG. 2 is a side view showing the waveguide orthomode transducer according to embodiment 1 of the present invention.

Figure 3:
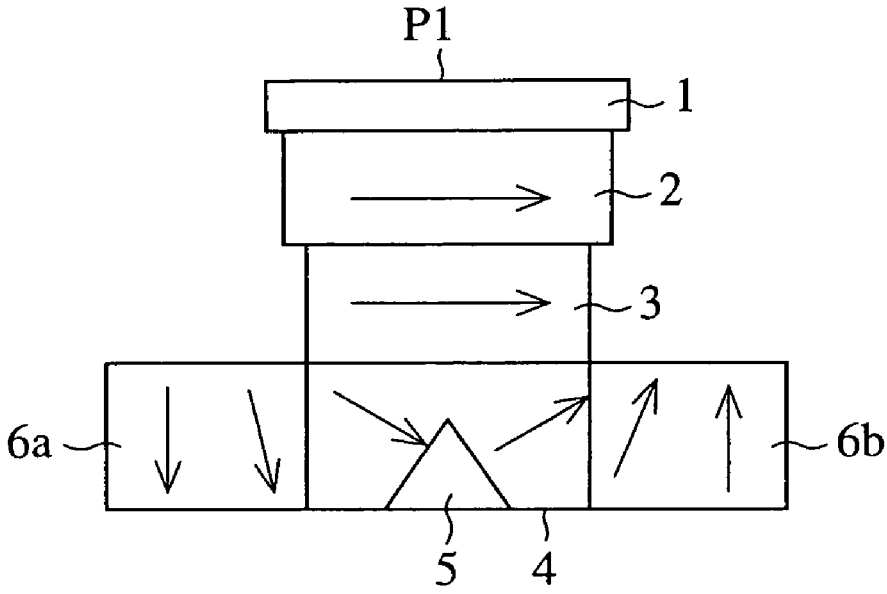
FIG. 3 is a side view showing a distribution of electric fields of a basic mode at a branch portion when a horizontally polarized wave is inputted to the waveguide orthomode transducer.
Figure 4:
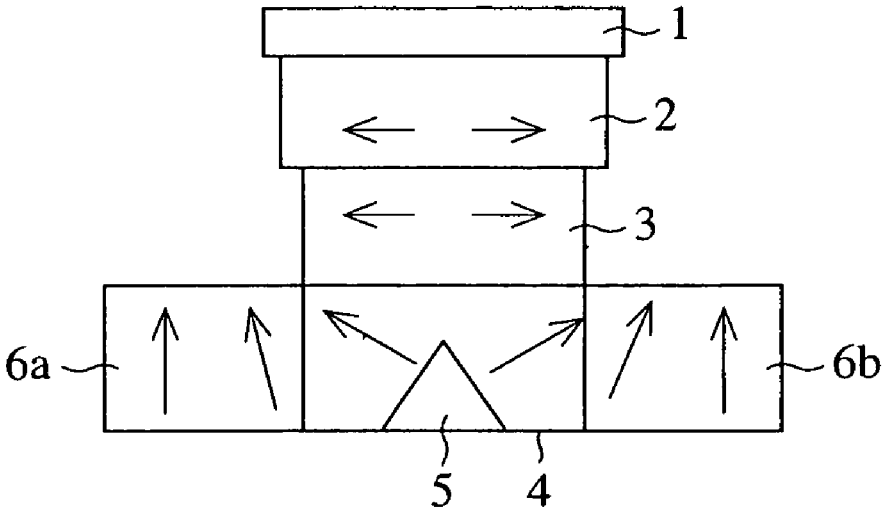
FIG. 4 is a side view showing a distribution of electric fields of a higher mode at the branch portion when the higher mode occurs.
Figure 5:
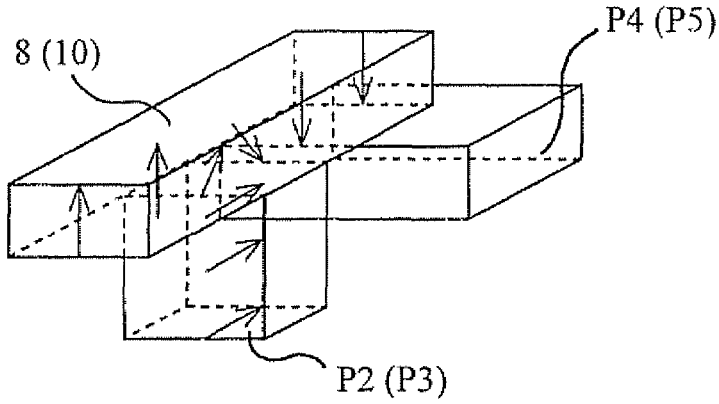
FIG. 5 is a perspective diagram showing a distribution of electric fields of the basic mode in a four branch circuit when a horizontally polarized wave is inputted to the waveguide orthomode transducer.
Figure 6:
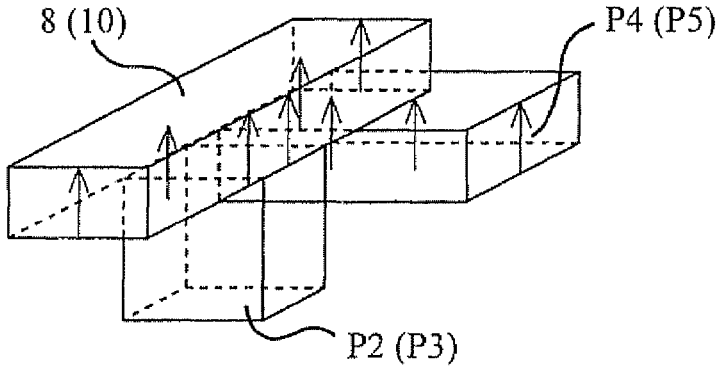
FIG. 6 is a perspective diagram showing a distribution of electric fields of the higher mode in the four branch circuit when the higher mode occurs.

FIG. 3 is a side view showing a distribution of electric fields of a basic mode at a branch portion when a horizontally polarized wave is inputted to the waveguide orthomode transducer, FIG. 4 is a side view showing a distribution of electric fields of a higher mode at the branch portion when the higher mode occurs, FIG. 5 is a perspective diagram showing a distribution of electric fields of the basic mode in a four branch circuit when a horizontally polarized wave is inputted to the waveguide orthomode transducer, and FIG. 6 is a perspective diagram showing a distribution of electric fields of the higher mode in the four branch circuit when the higher mode occurs.

In the figures, a circular main waveguide 1 conducts a circularly-polarized-wave signal inputted thereto via an input/output terminal P1 (i.e., a vertically polarized electric wave and a horizontally polarized electric wave). A square main waveguide (i.e., a first square main waveguide) 2 conducts the circularly-polarized-wave signal conducted by the circular main waveguide 1. Another square main waveguide (i.e., a second square main waveguide) 3 has an opening diameter narrower than that of the square main waveguide 2, branches the horizontally polarized electric wave of the circularly-polarized-wave signal conducted by the square main waveguide 2 toward directions designated by an arrow H (i.e., first horizontal symmetrical directions), and also branches the vertically polarized electric wave of the circularly-polarized-wave signal toward directions designated by an arrow V (i.e., second horizontal symmetrical directions).

In the example of FIGS. 1 and 2, the square main waveguide 3 has a smaller opening diameter than the square main waveguide 2, and the square main waveguide 2 has a smaller opening diameter than the circular main waveguide 1, as previously mentioned. As an alternative, the square main waveguide 3 can have a larger opening diameter than the square main waveguide 2, and the square main waveguide 2 can have a larger opening diameter than the circular main waveguide 1.

A short-circuit plate 4 blocks one end of the square main waveguide 3, and a quadrangular-pyramid-shaped metallic block 5 is placed on the short-circuit plate 4 and separates the incoming circularly-polarized-wave signal into the vertically polarized electric wave and the horizontally polarized electric wave. An electric wave branch means is comprised of the circular main waveguide 1, the square main waveguides 2 and 3, the short-circuit plate 4, and the quadrangular-pyramid-shaped metallic block 5.

Rectangular waveguide branching units 6*a* and 6*d* are connected to side walls of the square main waveguide 3 at right angles with respect to the four axes of the square main waveguide 3, respectively. Rectangular waveguide multi stage transformers 7*a* to 7*d* are connected to the rectangular waveguide branching units 6*a* to 6*d*, respectively, and have their respective axes which are curved in an H plane. The rectangular waveguide multi stage transformers 7*a* to 7*d* are transformers each of which has an opening diameter that decreases with distance from a corresponding one of the rectangular waveguide branching units 6*a* to 6*d*.

A rectangular waveguide four-branch circuit 8 combines a horizontally polarized electric wave conducted by the rectangular waveguide multi stage transformer 7*a* and a horizontally polarized electric wave conducted by the rectangular waveguide multi stage transformer 7*b* into a composite signal, and outputs an electric wave of a basic mode included in the composite signal to an input/output terminal P2, and outputs an electric wave of a higher mode to an input/output terminal P4. The input/output terminal P4 has an end that is blocked by a short-circuit plate 9 and is constructed of a dielectric with loss.

A rectangular waveguide four-branch circuit 10 combines a vertically polarized electric wave conducted by the rectangular waveguide multi stage transformer 7*c* and a vertically polarized electric wave conducted by the rectangular waveguide multi stage transformer 7*d* into a composite signal, and outputs an electric wave of a basic mode included in the composite signal to an input/output terminal P3, and outputs an electric waves of a higher mode to an input/output terminal P5. The input/output terminal P5 has an end that is blocked by a short-circuit plate 11 and is constructed of a dielectric with loss.

The rectangular waveguide branching units 6*a* and 6*b*, the rectangular waveguide multi stage transformers 7*a* and 7*b*, and the rectangular waveguide four-branch circuit 8 constitute a first radio wave conducting means, and the rectangular waveguide branching units 6*c* and 6*d*, the rectangular waveguide multi stage transformers 7*c* and 7*d*, and the rectangular waveguide four-branch circuit 10 constitute a second radio wave conducting means.

Next, the operation of the waveguide orthomode transducer in accordance with embodiment 1 of the present invention will be explained.

When a horizontally polarized electric wave H of a basic mode (i.e., TE01 mode) is inputted to the waveguide orthomode transducer via the input/output terminal P1, the circular main waveguide 1 and the square main waveguides 2 and 3 conduct the horizontally polarized electric wave H.

When the horizontally polarized electric wave H then reaches the quadrangular-pyramid-shaped metallic block 5, the quadrangular-pyramid-shaped metallic block 5 branches the horizontally polarized electric wave H toward the direction of the rectangular waveguide branching unit 6*a* and the direction of the rectangular waveguide branching unit 6*b* (i.e., the directions designated by the arrow H of FIG. 1).

In other words, since each of the rectangular waveguide branching units 6*c* and 6*d* is designed so that the gap between upper and lower side walls thereof has a width equal to or less than one half of the free-space wavelength in an available frequency band, the horizontally polarized electric wave H is not branched toward the directions of the rectangular waveguide branching units 6*c* and 6*d* (i.e., the directions designated by the arrow V of FIG. 1) because of the shielding effects by the rectangular waveguide branching units 6*c* and 6*d*, but is branched toward the directions of the rectangular waveguide branching units 6*a* and 6*b* (i.e., the directions designated by the arrow H of FIG. 1).

Furthermore, as shown in FIG. 3, since the orientations of electric fields can be changed along with the quadrangular-pyramid-shaped metallic block 5 and the short-circuit plate 4, there is provided a distribution of electric fields which is caused by an equivalent structure in which two rectangular waveguide E plane miter bends having excellent reflection characteristics are arranged symmetrically with respect to each other. For this reason, the horizontally polarized electric wave H is efficiently outputted toward the rectangular waveguide branching units 6*a* and 6*b* while leakage of the horizontally polarized electric wave H toward the rectangular waveguide branching units 6*c* and 6*d* is prevented.

Since a connecting point between the circular main waveguide 1 and the square main waveguide 2, the square main waveguide 2, and a connecting point between the square main waveguide 2 and the square main waveguide 3 serve as a circular-to-rectangular waveguide multi stage transformer, the multi stage transformer can be made to have reflection characteristics showing that the reflection loss is large in a frequency band in the vicinity of the cut-off frequency of the horizontally polarized electric wave H of the basic mode and the reflection loss can be reduced to a very small one in another frequency band which is somewhat higher than the cut-off frequency, by suitably designing the diameter of the circular main waveguide 1 and the diameter and axis length of the square main waveguide 2. The reflection characteristics of the multi stage transformer are similar to those of the above-mentioned branch portion. Therefore, when the above-mentioned circular-to-rectangular waveguide multi stage transformer is placed at a position where electric waves reflected from the branch portion and electric waves reflected from the above-mentioned circular-to-rectangular waveguide multi stage transformer cancel each other out in the frequency band in the vicinity of the cut-off frequency of the horizontally polarized electric wave H of the basic mode, the degradation in the reflection characteristics in the frequency band in the vicinity of the cut-off frequency can be suppressed without degradation in the good reflection characteristics in the other frequency band which is somewhat higher than the cut-off frequency of the horizontally polarized electric wave H of the basic mode.

In addition, since each of the rectangular waveguide multi stage transformers 7*a* and 7*b* has a curved axis, and two or more steps are formed on an upper wall of each of the rectangular waveguide multi stage transformers 7*a* and 7*b* and are arranged at intervals of about ¼ of the wavelength of electric waves conducting through the waveguide along a direction of the centerline of the waveguide, a part conducting toward the rectangular waveguide branching unit 6*a* and another part conducting toward the rectangular waveguide branching unit 6*b*, into which the electric wave H has been separated, are combined into a composite electric wave by the rectangular waveguide four-branch circuit 8, and the electric wave is efficiently outputted via the input/output terminal P2 without degradation in the reflection characteristics in the other frequency band which is somewhat higher than the cut-off frequency of the horizontally polarized electric wave H of the basic mode (see FIG. 5).

On the other hand, when a vertically polarized electric wave V of a basic mode (i.e., TE10 mode) is inputted thereto via the input/output terminal P1, the circular main waveguide 1 and the square main waveguides 2 and 3 conduct the vertically polarized electric wave V.

When the vertically polarized electric wave V then reaches the quadrangular-pyramid-shaped metallic block 5, the quadrangular-pyramid-shaped metallic block 5 branches the vertically polarized electric wave V toward the direction of the rectangular waveguide branching unit 6*c* and the direction of the rectangular waveguide branching unit 6*d* (i.e., the directions designated by the arrow V of FIG. 1).

In other words, since each of the rectangular waveguide branching units 6*a* and 6*b* is designed so that the gap between upper and lower side walls thereof has a width equal to or less than one half of the free-space wavelength in the available frequency band, the vertically polarized electric wave V is not branched toward the directions of the rectangular waveguide branching units 6*a* and 6*b* (i.e., the directions designated by the arrow H of FIG. 1) because of the shielding effects by the rectangular waveguide branching units 6*a* and 6*b*, but is branched toward the directions of the rectangular waveguide branching units 6*c* and 6*d* (i.e., the directions designated by the arrow V of FIG. 1).

Furthermore, since the orientations of electric fields can be changed along with the quadrangular-pyramid-shaped metallic block 5 and the short-circuit plate 4, there is provided a distribution of electric fields which is caused by an equivalent structure in which two rectangular waveguide E plane miter bends having excellent reflection characteristics are arranged symmetrically with respect to each other. For this reason, the vertically polarized electric wave V is efficiently outputted toward the rectangular waveguide branching units 6*c* and 6*d* while leakage of the vertically polarized electric wave V toward the rectangular waveguide branching units 6*a* and 6*b* is prevented.

Since the connecting point between the circular main waveguide 1 and the square main waveguide 2, the square main waveguide 2, and the connecting point between the square main waveguide 2 and the square main waveguide 3 serve as the circular-to-rectangular waveguide multi stage transformer, the multi stage transformer can be made to have reflection characteristics showing that the reflection loss is large in a frequency band in the vicinity of the cut-off frequency of the vertically polarized electric wave V of the basic mode and the reflection loss can be reduced to a very small one in another frequency band which is somewhat higher than the cut-off frequency, by suitably designing the diameter of the circular main waveguide 1 and the diameter and axis length of the square main waveguide 2. The reflection characteristics of the multi stage transformer are similar to those of the above-mentioned branch portion. Therefore, when the above-mentioned circular-to-rectangular waveguide multi stage transformer is placed at a position where electric waves reflected from the branch portion and electric waves reflected from the above-mentioned circular-to-rectangular waveguide multi stage transformer cancel each other out in the frequency band in the vicinity of the cut-off frequency of the vertically polarized electric wave V of the basic mode, the degradation in the reflection characteristics in the frequency band in the vicinity of the cut-off frequency can be suppressed without degradation in the good reflection characteristics in the other frequency band which is somewhat higher than the cut-off frequency of the vertically polarized electric wave V of the basic mode.

In addition, since each of the rectangular waveguide multi stage transformers 7*c* and 7*d* has a curved axis, and two or more steps are formed on an upper wall of each of the rectangular waveguide multi stage transformers 7*c* and 7*d* and are arranged at intervals of about ¼ of the wavelength of electric waves conducting through the waveguide along the direction of the centerline of the waveguide, a part conducting toward the rectangular waveguide branching unit 6*c* and another part conducting toward the rectangular waveguide branching unit 6*d*, into which the electric wave V has been separated, are combined into a composite electric wave by the rectangular waveguide four-branch circuit 10, and the electric wave is efficiently outputted via the input/output terminal P3 without degradation in the reflection characteristics in the other frequency band which is somewhat higher than the cut-off frequency of the vertically polarized electric wave V of the basic mode (see FIG. 5).

In this embodiment, a horizontally polarized electric wave of the basic mode and a vertically polarized electric wave of the basic mode are inputted to the waveguide orthomode transducer via the input/output terminal P1, as previously mentioned. When the symmetric property of the square main waveguide 2 collapses due to machining errors etc. and a higher mode (e.g., TE11 mode) occurs at a discontinuous portion, for example, a distribution of electric fields as shown in FIG. 4 is provided. As a result, a horizontally polarized electric wave H of the higher mode is conducted through the insides of the rectangular waveguide multi stage transformer 7*a* and 7*b*, and a vertically polarized electric wave V of the higher mode is conducted through the insides of the rectangular waveguide multi stage transformer 7*c* and 7*d*.

In this case, since the distribution of electric fields becomes a one in which two H plane bends are combined, as shown in FIG. 6, the two conducted waves are respectively combined by the rectangular waveguide four-branch circuits 8 and 10, and are respectively outputted to the input/output terminals P4 and P5.

Since each of the input/output terminals P4 and P5 is constructed of a dielectric with loss, the electric waves of the higher mode combined by the rectangular waveguide four-branch circuits 8 and 10 are respectively absorbed by the input/output terminals P4 and P5.

As a result, even if a higher mode occurs due to machining errors etc., it is possible to prevent confinement resonance which is caused by total reflection of in-phase conducted waves by the rectangular waveguide four-branch circuits 8 and 10.

Although the description of the above-mentioned principle of operation of the waveguide orthomode transducer is directed to the case where the input/output terminal P1 is used as the input terminal and the input/output terminals P2 and P3 are used as the output terminal, the principle of operation of the waveguide orthomode transducer can be applied to a case where the input/output terminals P2 and P3 are used as the input terminal and the input/output terminal P1 is used as the output terminal.

As can be seen from the above description, the waveguide orthomode transducer in accordance with this embodiment 1 is provided with a first radio wave conducting means for conducting an electric wave of a horizontally polarized wave branched by an electric wave branch means, for conducting another electric wave of the horizontally polarized wave, for combining the electric waves of the horizontally polarized wave into one electric wave and dividing this electric wave into an electric wave of a basic mode and an electric wave of a higher mode, and for outputting them, and a second radio wave conducting means for conducting one electric wave of a vertically polarized wave branched by the electric wave branch means, for conducting another electric wave of the vertically polarized wave, for combining the electric waves of the vertically polarized wave into one electric wave and dividing this electric wave into an electric wave of a basic mode and an electric wave of a higher mode, and for outputting them. Therefore, the present embodiment offers an advantage of being able to do miniaturization of the waveguide orthomode transducer and reduce the length of the axis of the waveguide orthomode transducer, and to enhance the performance of the waveguide orthomode transducer.

In other words, the present embodiment offers an advantage of being able to provide good reflection and isolation characteristics in a wide frequency band including frequencies close to the cut-off frequency of the basic mode of the square main waveguide. Since the lengths of the square main waveguides along the direction of the axis of the waveguides can be reduced, the waveguide orthomode transducer can come down in size.

Furthermore, since the waveguide orthomode transducer has a structure of not using any metallic thin plate and any metallic post, the present embodiment offers another advantage of being able to reduce the degree of difficulty in machining the waveguide orthomode transducer and hence to reduce the cost of the waveguide orthomode transducer.

Embodiment 2

Figure 7:
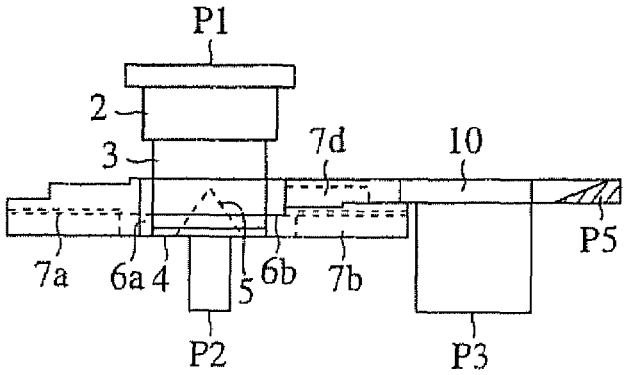
FIG. 7 is a side view showing a waveguide orthomode transducer according to embodiment 2 of the present invention.

In accordance with above-mentioned embodiment 1, the circular main waveguide 1 is connected to the upper end of the square main waveguide 2, as previously mentioned. As shown in FIG. 7, the circular main waveguide 1 does not have to be connected to the upper end of the square main waveguide 2. This embodiment can offer the same advantages as provided by above-mentioned embodiment 1.

In the example of FIG. 7, the square main waveguide 3 has a smaller opening diameter than the square main waveguide 2. As an alternative, the square main waveguide 3 can have a larger opening diameter than the square main waveguide 2.

INDUSTRIAL APPLICABILITY

As mentioned above, the waveguide orthomode transducer according to the present invention can be used in, for example, a VHF band, a UHF band, a microwave band, and a millimeter wave band.

The invention claimed is:

1. A waveguide orthomode transducer comprising:

an electric wave branch means for branching a horizontally polarized electric wave included in a circularly-polarized-wave signal inputted thereto toward first horizontal symmetrical directions, and for branching a vertically polarized electric wave included in the circularly-polarized-wave signal toward second horizontal symmetrical directions;

a first radio wave conducting means for conducting a first electric wave of the horizontally polarized electric wave branched by said electric wave branch means, for conducting a second electric wave of the horizontally polarized electric wave, for combining the first and second electric waves of the horizontally polarized electric wave and dividing the combined electric wave into a first basic mode electric wave and a first higher mode electric wave, and for outputting them;

and a second radio wave conducting means for conducting a first electric wave of the vertically polarized electric wave branched by said electric wave branch means, for conducting a second electric wave of the vertically polarized electric wave, for combining the first and second electric waves of the vertically polarized electric wave and dividing the combined electric wave into a second basic mode electric wave and a second higher mode electric wave, and for outputting them.

2. The waveguide orthomode transducer according to claim 1, wherein said electric wave branch means is provided with a circular main waveguide for conducting the circularly-polarized-wave signal inputted thereto via an input/output terminal, a first square main waveguide for conducting the circularly-polarized-wave signal conducted by said circular main waveguide, and a second square main waveguide having an opening diameter different from that of said first square main waveguide, for branching the horizontally polarized electric wave included in the circularly-polarized-wave signal conducted by said first square main waveguide toward the first horizontal symmetrical directions, and for branching the vertically polarized electric wave included in the circularly-polarized-wave signal toward the second horizontal symmetrical directions.

3. The waveguide orthomode transducer according to claim 1, wherein said electric wave branch means is provided with a first square main waveguide for conducting the circularly-polarized-wave signal inputted thereto via an input/output terminal, and a second square main waveguide having an opening diameter different from that of said first square main waveguide; for branching the horizontally polarized electric wave included in the circularly-polarized-wave signal conducted by said first square main waveguide toward the first horizontal symmetrical directions, and for branching the vertically polarized electric wave included in the circularly-polarized-wave signal toward the second horizontal symmetrical directions.

4. The waveguide orthomode transducer according to claim 2, wherein said second square main waveguide has an end connected to said first square main waveguide and an opposite end blocked by a short-circuit plate on which a quadrangular-pyramid-shaped metallic block is placed.

5. The waveguide orthomode transducer according to claim 3, wherein said second square main waveguide has an end connected to said first square main waveguide and an opposite end blocked by a short-circuit plate on which a quadrangular-pyramid-shaped metallic block is placed.

6. The waveguide orthomode transducer according to claim 1, wherein each of said first and second radio wave conducting means has a terminal for outputting said first and second higher mode electric waves respectively, which is blocked by a short-circuit plate and which is constructed of a dielectric with loss.

7. A method for branching polarized electric wave, comprising:

branching a horizontally polarized electric wave included in a circularly-polarized-wave signal inputted thereto toward first horizontal symmetrical directions;

branching a vertically polarized electric wave included in the circularly-polarized-wave signal toward second horizontal symmetrical directions;

conducting a first electric wave of the horizontally polarized electric wave;

conducting a second electric wave of the horizontally polarized electric wave;

combining the first and second electric waves of the horizontally polarized electric wave and dividing the combined electric wave into a first basic mode electric wave and a first higher mode electric wave, and outputting them;

conducting a first electric wave of the vertically polarized electric wave;

conducting a second electric wave of the vertically polarized electric wave;

combining the first and second electric waves of the vertically polarized electric wave and dividing the combined electric wave into a second basic mode electric wave and a second higher mode electric wave, and outputting them.

* * * * *